US005836482A

United States Patent [19]

Ophardt et al.

[11] Patent Number: 5,836,482

[45] Date of Patent: Nov. 17, 1998

[54] AUTOMATED FLUID DISPENSER

[76] Inventors: Hermann Ophardt, Lindenau 27, D-47661 Issum, Germany; Heiner Ophardt, 3931 Vineland Crescent, Vineland, Ontario, Canada

[21] Appl. No.: 833,263

[22] Filed: Apr. 4, 1997

[51] Int. Cl.[6] ..... B65D 88/54

[52] U.S. Cl. ..... 222/325; 222/52; 222/181.1; 222/333

[58] Field of Search ..... 222/325, 333, 222/52, 643, 644

[56] References Cited

U.S. PATENT DOCUMENTS

| | | | |
|---|---|---|---|
| 4,154,375 | 5/1979 | Bippus | 222/333 X |
| 4,187,959 | 2/1980 | Pelton | 222/94 |
| 4,421,251 | 12/1983 | Namdari et al. | 222/325 X |
| 4,735,345 | 4/1988 | Lee | 222/131 |
| 4,946,070 | 8/1990 | Albert | 222/52 |
| 4,946,072 | 8/1990 | Albert | 222/105 |
| 4,967,935 | 11/1990 | Celest | 222/63 |
| 5,105,992 | 4/1992 | Fender | 222/185 |
| 5,433,351 | 7/1995 | Okuyama et al. | 222/214 |

*Primary Examiner*—Gregory L. Huson
*Attorney, Agent, or Firm*—Riches, McKenzie & Herbert

[57] ABSTRACT

A device for controlled automatic dispensing of fluids comprising a housing carrying an electric motor and a disposable, removable unit incorporating a container carrying fluid to be dispensed and a pump. The removable unit is adapted to be removably coupled to the motor to drive the pump simultaneously with the container being removably coupled to the housing. The unit preferably also carries a battery with an electric capacity sufficient to drive the motor to dispense all the fluid in the container. The unit other than the removable battery is made of recyclable plastic.

20 Claims, 7 Drawing Sheets

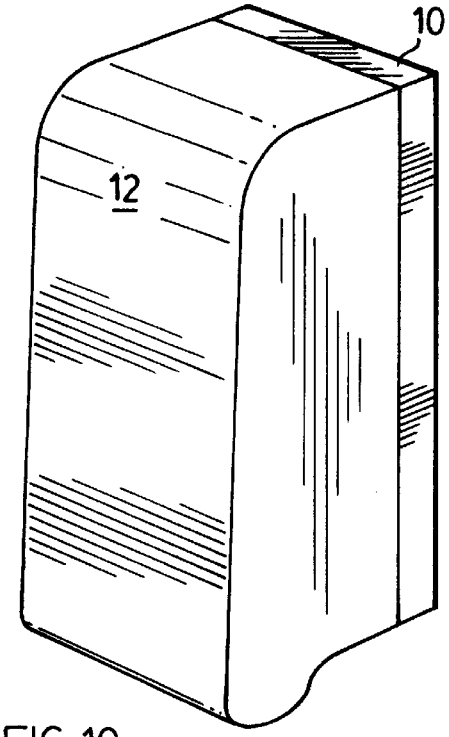
FIG. 10.
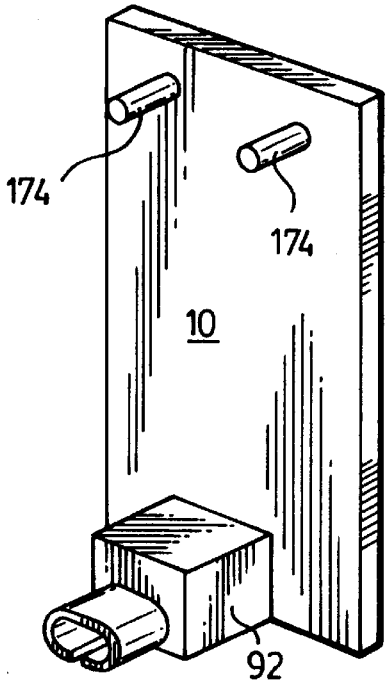
FIG. 12.
FIG. 11.
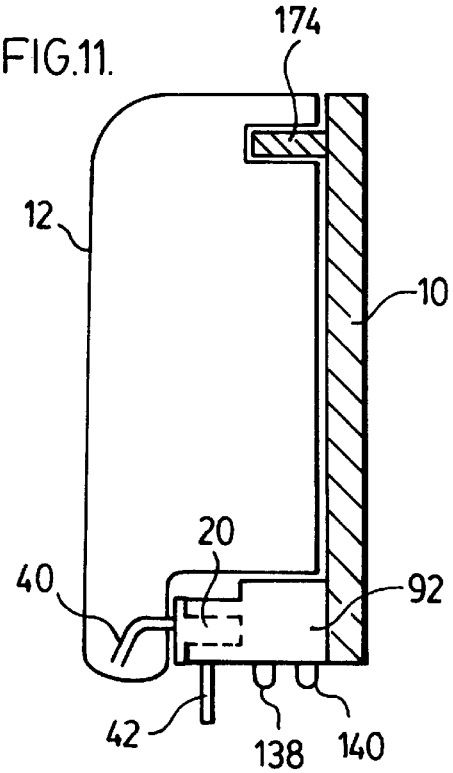
FIG. 13.
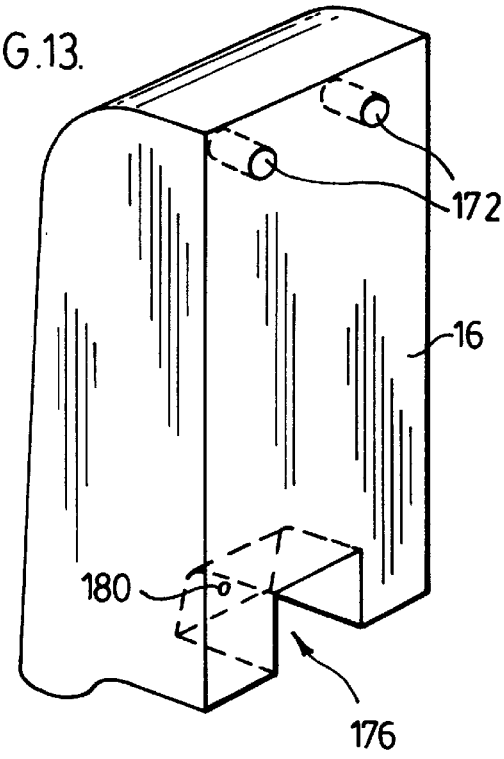

AUTOMATED FLUID DISPENSER

FIELD OF THE INVENTION

This invention relates to fluid dispensers generally and, more particularly, for a device for controlled automatic dispensing of fluids such as hand soaps, antiseptic skin cleaners, liquid medicines, fluid foods including milk and cream and concentrates for coffee, juice, tea and soup, fluid condiments such as ketchup and mustard and other fluids which may be desired to be automatically dispensed preferably in controlled quantities.

BACKGROUND OF THE INVENTION

Automated dispensers for soap and other fluids are known such as taught by U.S. Pat. No. 4,946,007 to Albert, issued Aug. 7, 1990; U.S. Pat. No. 4,967,935 to Celest, issued Nov. 6, 1990 and U.S. Pat. No 5,105,992 to Fender et al, issued Apr. 21, 1992. These dispensers teach battery operated wall mounted soap dispensers which are adapted to dispense a pre-selected quantity of soap. These devices each suffer the disadvantage that the nature of their motorized mechanism adapted to dispense the soap is complex and energy inefficient and, therefore, is prone to failure and requires substantial battery capacity for dispensing a container of soap. The devices also suffer the disadvantage of providing complex arrangements for automated dispensing of the soap in which removable containers containing the soap fluid are engaged in relatively complex configurations within housings for the containers. Such complex configurations give rise to difficulties in respect of installation and removal of the containers and the potential for contamination.

SUMMARY OF THE INVENTION

To at least partially overcome these disadvantages of previously known devices, the present invention provides a device for controlled dispensing of a fluid incorporating a pump, preferably, a rotary pump. Preferably, the rotary pump comprises an integral part of a disposable, removable unit also including a container filled with fluid to be dispensed. The removable unit is adapted to be removably secured to the device such that the pump is removably coupled to a motor to drive the pump. Preferably, the container and pump are formed entirely from recyclable plastic materials and can be easily recycled.

Preferably, the motor is an electric motor powered by replaceable batteries. The removable, disposable unit comprising the container and pump may also include batteries having a capacity sufficient to dispense the fluid from the container. Preferably, the batteries may become electrically connected with a motor control mechanism by the coupling of the remainder of the unit to a permanent housing of the dispenser. Preferably, a unit comprising a container and a pump may be removed merely by horizontal sliding of the unit relative the housing and with both the container and the pump becoming engaged with the housing in such horizontal sliding.

An object of the present invention is to provide an improved configuration for a pump for a dispenser of soap and other liquids.

Another object is to provide a fluid dispensing device which utilizes as an integral unit a container for fluids to be dispensed and a disposable pump.

Another object is to provide an inexpensive recyclable and disposable pump which can be incorporated at low cost as part of a disposable unit containing fluid to be dispensed.

Another object is to provide an energy efficient system to pump fluid from a dispenser which is adapted to require minimal power to operate.

Another object is to provide an arrangement for sensing when a fluid container in a dispenser is empty.

Another object is to provide a dispenser for fluids adapted to receive two replaceable containers for fluid with a control mechanism to dispense fluid from either of the containers, sense when either container is empty and then switch to dispense from one container to the other container.

Accordingly, in one aspect the present invention provides a device for dispensing a fluid comprising:

a housing;

a removable, replaceable unit removably mounted to the housing;

the unit including: a container for fluid to be dispensed; and a pump activable to dispense fluid from the container;

the pump having a rotatable input member extending therefrom; the pump operative to dispense fluid from the container by rotation of the input member, the housing comprising:

a motor with a rotatable output member; and a motor control mechanism for controlling operation of the motor;

the motor output member removably coupled to the input member of the pump for rotation of the pump on operation of the motor, the motor comprising an electric direct current motor with a rotor journalled for rotation about an axle relative a stator fixed to the housing, a coaxial extension of the axle comprising the motor output member;

the pump removably coupling with the motor by sliding of the pump relative the housing parallel the axle of the motor, the container removably coupling with the housing for support of the container by the housing by sliding of the container relative the housing parallel the axle of the motor such that by sliding of the unit relative the housing the container is coupled to the housing and simultaneously the pump is coupled to the motor.

Accordingly, in another aspect, the present invention provides a device for dispensing a fluid comprising:

a housing;

a removable, replaceable unit removably mounted to the housing;

the unit including: a container for fluid to be dispensed; and a pump activable to dispense fluid from the container;

the pump comprising: a casing, an enclosed cavity defined within the casing, and two gear-like impellers each having an axis and radially extending teeth;

the impellers journalled for rotation within the cavity adjacent each other with their axes parallel and with teeth of one impeller intermeshing with the teeth of the other impeller in a nip between the impellers, an inlet port through the casing open to the cavity on a first side of the nip, an outlet port through the casing open to the cavity on a second side of the nip opposite the first side, interior surfaces of the cavity closely enclosing the impellers such that on rotation of the impellers, fluid is impounded in spaces between adjacent teeth of each impeller and interior surfaces of the casing and moved with rotation of each impeller circumferentially from one side of the nip where the teeth disengage from intermeshing to the other side of the nip where the teeth engage into intermeshing, the inlet port communicating with the container;

the outlet port communicating with an outlet, wherein on rotation of one of the impellers in a pumping direction, the pump pumps fluid from the container via the inlet port to the cavity through the cavity and via the outlet port out of the cavity to the outlet;

the pump having a rotatable input member coupled to one of the impellers for rotation together and extending out of the casing;

the housing comprising:

a motor with a rotatable output member; and a motor control mechanism for controlling operation of the motor;

the motor output member removably coupled to the input member of the pump for rotation of the impellers of the pump on operation of the motor.

BRIEF DESCRIPTION OF THE DRAWINGS

Further aspects and advantages of the present invention will become apparent from the following description taken together with the accompanying drawings in which:

FIG. 10 shows a pictorial view of a fourth embodiment of a soap dispenser in accordance with the present invention;

FIG. 11 shows a cross-sectional side view of a dispenser in FIG. 10;

FIG. 12 shows a pictorial view of the housing of the dispenser of FIG. 10; and FIG. 13 shows a pictorial rear view of the fluid container of FIG. 10.

DESCRIPTION OF THE DRAWINGS

Figure 1:
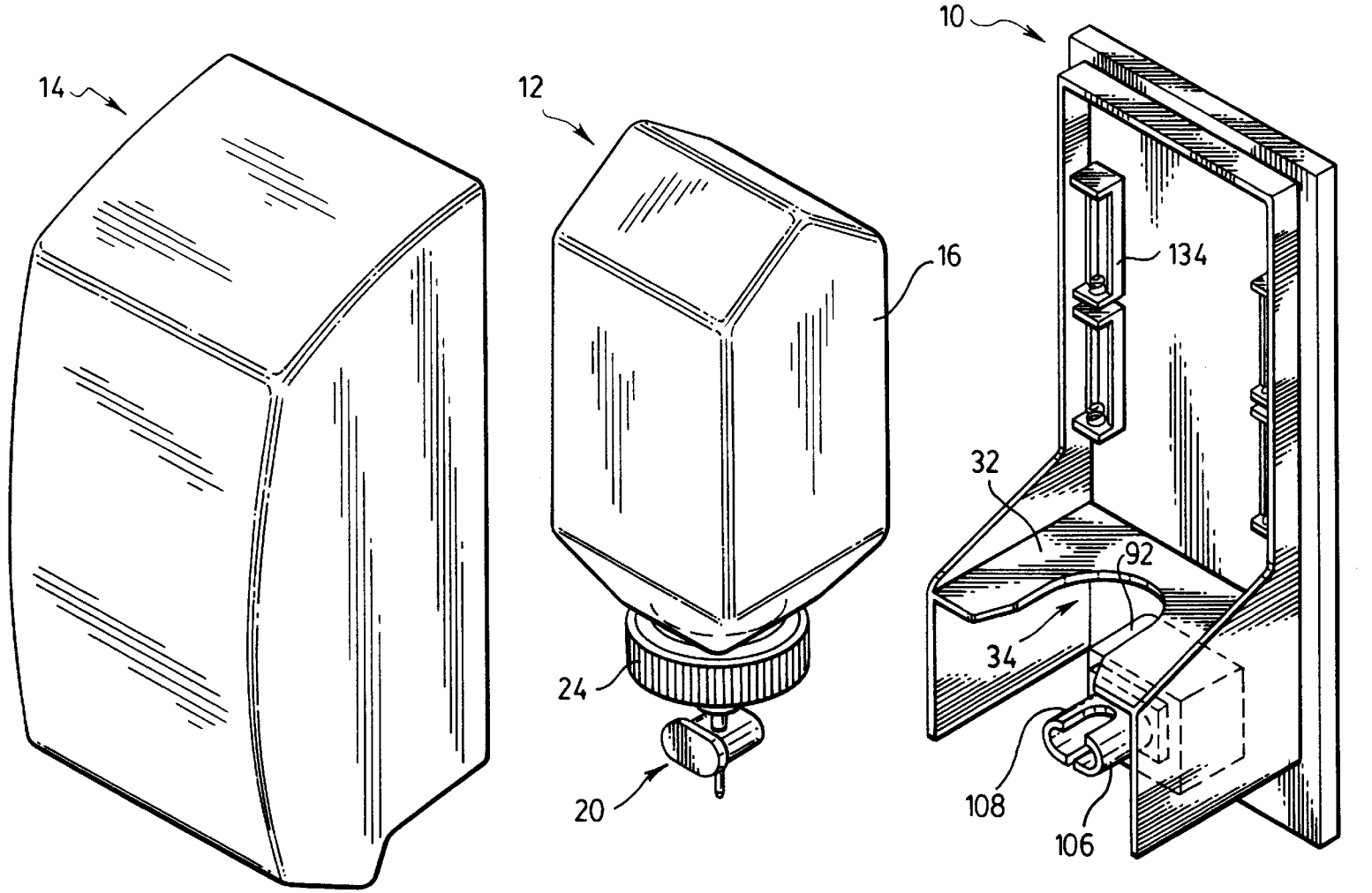
FIG. 1 is an exploded perspective view of a first preferred embodiment of a soap dispenser in accordance with the present invention.

Reference is made first to FIG. 1 which shows an exploded view of a first preferred embodiment of a soap dispenser in accordance with the present invention. The dispenser comprises a housing 10, a replaceable soap and pump unit 12 and a cover 14. The housing 10 is adapted to be mounted vertically as to a wall. The cover 14 is adapted to be coupled to the housing to permit insertion and removal of the unit 12 preferably as in a known manner with the cover 14 hingedly connected to the housing 12. The replaceable unit 12 comprises a collapsible fluid container 16 and a pump 20.

Figure 2:
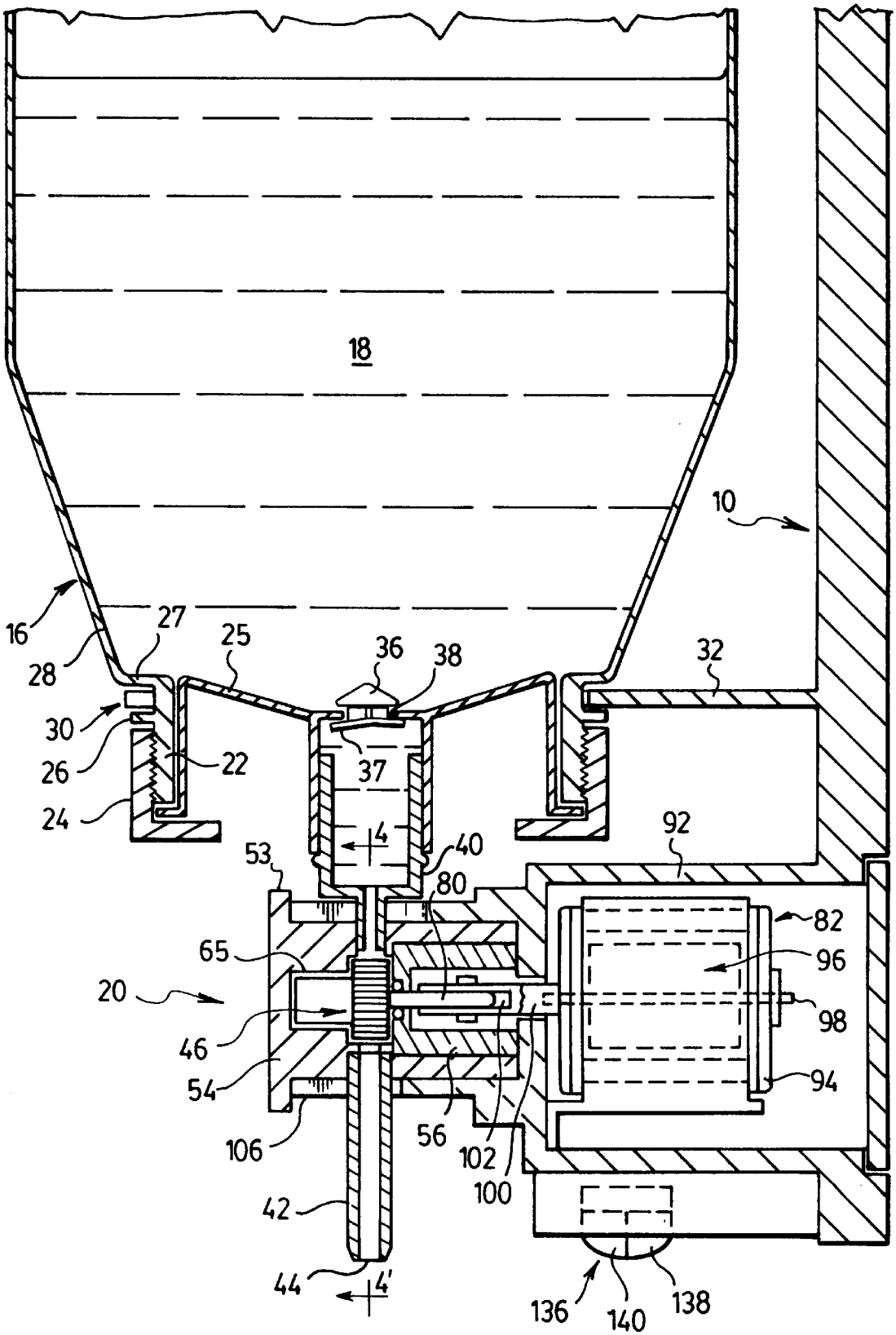
FIG. 2 is a partial cross-sectional side view through the soap dispenser of FIG. 1 in an assembled condition and with the cover removed.

Reference is made to FIG. 2 which shows in cross-section the container 16 filled with fluid 18. The container 16 has a cylindrical outlet neck 22 which is externally threaded at its end to threadably receive a cap 24. The neck 22 has a radially outwardly extending flange 26 disposed closely under a radially outwardly extending portion 27 of the wall 28 of the container so as to present a radially extending support slot 30 therebetween. The housing 10 has a horizontally extending support plate 32 with a forwardly open U-shaped slot 34 therein sized to be complementary to support slot 30 such that the support plate 32 can be received in slot 30 and support the weight of the container 16 and locate the container in a desired position. In this regard, the U-shaped slot preferably is of a width substantially the same as the outer diameter of the neck 22 and the inner bight of the opening has a radius corresponding to that of the neck 22. While not shown, some biasing mechanism is preferably provided to retain the neck 22 fully received in the desired position in the U-shaped opening 34 against displacement. The cap 24 has a funnel-like plate 25 with a central opening 38 therethrough which opens into a feed tube 40. A flapper valve member 36 is located in opening 38 to form a one-way valve which prevents flow upwardly from the feed tube 40 into the container.

The flapper member 36 a resilient circular disc 37 disposed below plate 25 with peripheral surfaces of the disc biased upward into lower surfaces of the plate 25 about the opening 38 such that deformation of the disc 37 downwardly at its outer periphery permits fluid flow downwardly through opening 38, however with fluid flow in the opposite direction prevented.

Fluid passing through the one-way valve formed by member 36 is conducted via feed tube 40 to pump 20 and then from pump 20 via an exit tube 42 to out a dispensing outlet 44.

Figure 3:
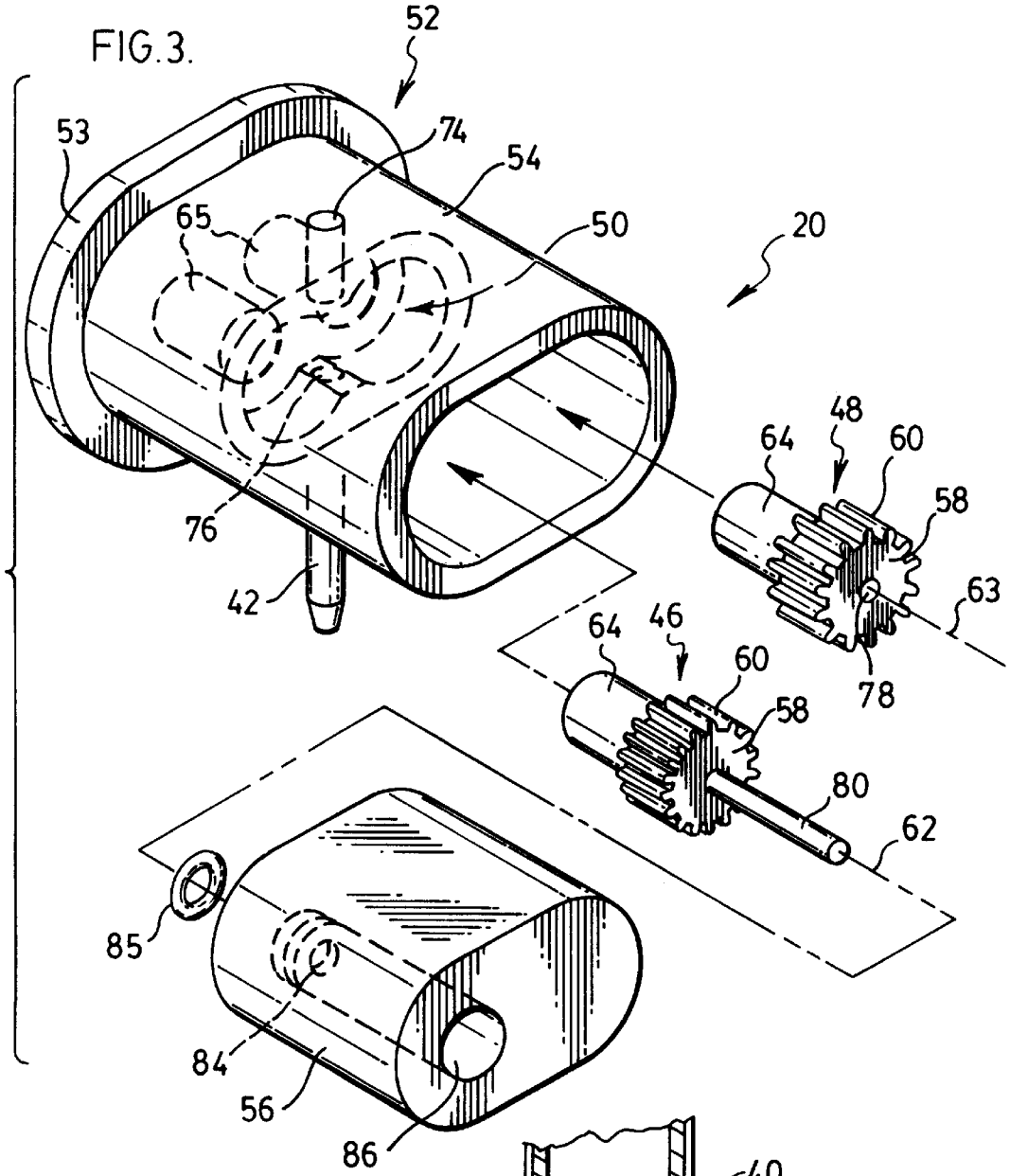
FIG. 3 is an exploded pictorial rear view of the pump of the dispenser shown in FIG. 1.
Figure 4:
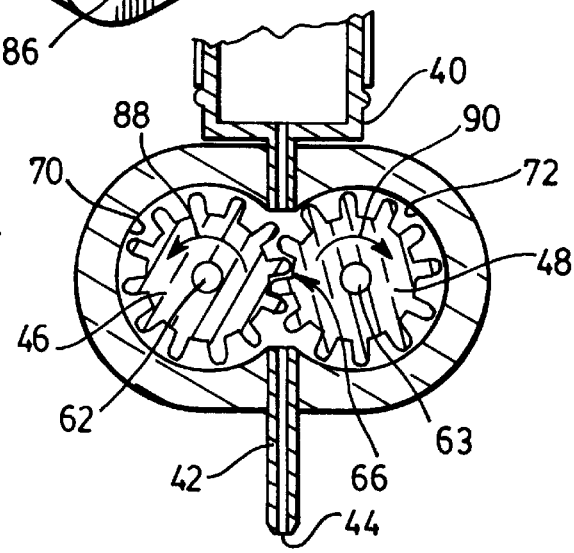
FIG. 4 is a cross-sectional rear view through the pump along section line 4—4' as seen in FIG. 2.

The construction of the pump 20 is best seen with reference to FIGS. 3 and 4. The pump 20 is a gear type rotary pump with two intermeshing gear-like impellers, namely, a driver impeller 46 and a driven impeller 48, received in a cavity 50 within a pump casing 52. The casing 52 comprises a primary casing member 54 with a removable casing plug 56 defining the cavity 50 therebetween.

The impellers 46 and 48 are identical with each adapted to be rotated about its respective axis 62 and 63. Each impeller has a gear portion 58 disposed coaxially about the axis with radially and axially extending teeth 60. Each impeller has an axle member 64 which extends axially from the gear portion 58 and serves to assist in journalling its impeller in the cavity 50.

As seen in FIG. 4, the cavity 50 is formed so as to journal the impellers 46 and 48 for rotation with the axes of the impellers parallel, with the impellers disposed beside each other and with the teeth of one impeller intermeshing with the teeth of the other impeller in a nip 66 between the impellers.

The cavity 50 is provided with flat, radially extending front and rear walls to relatively closely engage the flat, radially extending front and rear surfaces of the gear portions 58. The front wall of the cavity 50 is formed on the primary casing member 54 with two forwardly extending blind bores 65 sized to receive and journal the axle members 64 of the impellers to journal the impellers. The cavity 50 has circumferential side wall defined by part-cylinder forming surface 70 disposed at a constant radius from the axis 62 of the driver impeller 46 and part-cylinder forming surface 72 disposed at a constant radius from the axis 63 of driven impeller 48.

An inlet port 74 opens through the casing 52 into the cavity 50 on an upper side of the cavity 50 above the nip 66. The feed tube 40 is received in a friction fit relation in the inlet port 74 to permit fluid 18 in the container to be in communication with the cavity 50.

An outlet port 76 opens through the casing 52 into the cavity 50 on a lower side of the casing 50 below the nip 66. The exit tube 42 is received in a friction fit relation in the outlet port 76 to permit fluid from the cavity 50 to flow out of the dispensing outlet 44.

Each of the impellers 46 and 48 have a bore 78 extending coaxially along their respective axis. The driver impeller 46 has an axle extension rod 80 secured in its bore. The extension rod 80 extends rearwardly from the rear surface of the impeller 46 out of the pump casing 52 through the plug 56 for operative connection to a motor 82. In this regard, the plug 56 has a sealing aperture 84 having a shoulder sized to retain an 0-ring 85 to seal about the rod 80 and provide a substantially fluid seal. Aperture 84 opens rearwardly into an enlarged rearwardly directed opening 86.

When the motor 82 rotates the driver impeller 46 counterclockwise in the direction of the arrow 88 shown in FIG. 4, the driver impeller 46 engages the driven impeller 48 to rotate the driven impeller clockwise in the direction of arrow 90. Fluid 18 in the cavity 50 proximate the inlet port 74 is located in the space between adjacent teeth 60 of either of the impellers. On rotation of the teeth of one impeller away from the inlet port 74, the fluid between the adjacent teeth becomes impounded in spaces between the adjacent teeth 60 and the interior surfaces of the casing forming the cavity and the fluid so impounded is moved with rotation of each impeller circumferentially from near the inlet port 74 down to near the outlet port 76.

The intermeshing of the teeth 60 of the two gear-like portions in the nip 66 between the impellers substantially displaces fluid from the spaces between the teeth in the nip 66 so as, in effect, to prevent fluid from passing between the gear-like portions through the nip. The surfaces of the casing 52 forming the cavity 50 are disposed about the gear-like portions of the impellers to substantially seal fluid in spaces between adjacent teeth of the impellers. If the driver impellers 46 were rotated in an opposite direction, that is, clockwise, then the impellers would endeavour to pump fluid in a reverse direction from the outlet port 76 to the inlet port 74. In the case of rotation of the driver impeller in either direction, fluid is impounded in spaces between adjacent teeth of each impeller and interior surfaces of the cavity and moved with rotation of each impeller circumferentially from one side of the nip 66 where the teeth disengage from intermeshing to the other side of the nip where the teeth engage into intermeshing.

The motor 82 is mounted to the housing 10 in a motor casing 92 with a stator 94 secured to the casing 92 and a rotor 96 journalled for rotation coaxially within the stator 94 about an axle 98. The axle 98 carries an axle extension coupling 100 which extends coaxially forwardly from the motor casing 92. The axle extension coupling 100 is provided with an internal bore 52 into which the axle extension rod 80 of the pump is coaxially received in a removable friction fit relation such that rotation of the motor rotor 96 rotates the driver impeller 46 in unison. Preferably, the axle extension coupling 100 has its cylindrical wall about the internal bore 102 cut with longitudinally extending slots so as to provide resilient longitudinally extending finger-like members about the internal bore which are biased to assume a position in which they will frictionally engage the axle extension rod 80 of the pump when the axle extension rod 80 is inserted axially into the internal bore 102.

The motor casing 92 carries a forwardly opening socket 108 defined within a forwardly extending wall 106. Socket 108 has a cross-sectional shape, size and depth complementary to that of the casing 52. As shown in the preferred embodiment, the socket 108 and casing 52 have complementary oval shapes in cross-section. The casing 52 carries a stop flange 53 which extends radially relative the axis of the impellers at a forward end of the casing 52. The stop flange serves to engage a forward edge of the wall 106 when the casing 52 is fully inserted into socket 108. With initial insertion of the rear end of the casing 52 in the front end of the socket 108, the extension rod 80 is axially aligned with the extension coupling 100 and, on further manual rearward sliding of the casing 52 into the socket 108, the extension rod 80 becomes engaged within the internal bore 102 of the extension coupling 100 to thereby couple the rod 80 and the coupling 100. Insertion and removal of the unit 12 is accomplished by sliding the unit forwardly and rearwardly relative the housing 10 parallel the axis of the impellers, that is, parallel the axle of the motor, with the support plate 32 received in the support slot 30 and the casing 52 received in the socket 108. With such rearward and forward sliding, the pump 20 becomes engaged and disengaged with the motor 82. Preferably, by providing the casing 52 to engage within the socket 108 in a friction fit relation, on full insertion of the casing into the socket, the casing and socket will maintain their desired fully inserted relation until manual forces are applied to remove the casing from the socket.

The motor 80 is preferably a conventional electric motor to be driven by direct current from a power source. Such electric direct control motors are well known. Preferred such motors rotate at relatively high speed dependent on their windings and their power source. For typical direct current power sources, such as in the range of about 3 to 24 volts and, more preferably, in the range of 6 to 12 volts and for amperages in the range of 2 to 12 amps and, more preferably, 4 to 8 amps, such motors have energy efficient operation when rotating at relatively high rotational speeds preferably greater than 1,000 revolutions per minute (r.p.m.), more preferably, greater than 2,000 r.p.m. and, preferably, about 3,000 r.p.m. Preferred ranges of rotations of the motor rotor are in the range of 2,000 to 8,000 r.p.m., more preferably, in the range of 2,000 to 4,000 r.p.m.

As a power source for the motor 82, FIG. 1 shows the housing 10 as carrying four conventional mounting brackets 134 each sized to receive conventional batteries. The batteries are removably carried in the mounting brackets 134 on the housing 10 such that the batteries can readily be replaced when the unit 12 is removed. The batteries are electrically connected to the motor 82 in a known manner together with a control mechanism to control the operation of the motor.

The control mechanism at least includes an on/off switch to turn the motor on and off. In the simplest sense, the switch may comprise an on/off switch to be activated when manual pressure is applied by a user. Such a manual spring loaded on/off switch preferably is mounted underneath the motor casing 92 as at the position of element 136 in FIG. 2 so as to dispense fluid 18 into a person's hand when the person's fingers depresses the switch. Such a simple on/off switch is well known and may, for example, be spring biased to an off position and activable when pressure is applied to the switch.

More preferably, the control mechanism includes a proximity sensor which will sense the presence of a user's hand under the exit tube 42 and provide a signal to a control circuit coupling the sensor to the electric motor for actuating the motor. Such proximity sensor mechanisms are well known. Preferred sensors include thermal sensors which will sense the heat from a user's hand, motion sensors which will sense motion of a person's hand and photodetection sensors which will sense reflected signals from a signal emitting source provided on the dispenser. As one example, element 136 in FIG. 2 could comprise a thermal sensor which would sense heat from a user's hand when placed under the exit tube 42. As another example, the element 136 could comprise for example, an infrared light emitting diode 138 to transmit a pulse of infrared energy at predetermined timed intervals downwardly from the housing with a corresponding photo receiver 140 mounted along side the photo emitter 138 but shielded therefrom such that infrared energy of a predetermined configuration may be emitted by the diode 138 and when reflected off a user's hand placed beneath the dispenser will be received by the receiver 140 to signal the presence of a user's hand. Such a system is described, for example, in U.S. Pat. No. 4,967,935 to Celeste, issued Nov. 6, 1990.

The control mechanism preferably controls the supply of power to the motor 82 so that whenever it is desired that fluid be dispensed, the motor is operated for a pre-selected period of time which will dispense a single dose being approximately a predetermined quantity of fluid. One preferred operation would be to control operation of the pump such that the pump, after dispensing as a unit dose, a predetermined quantity of fluid, would not be operated for a delay period of for example five to fifteen seconds or would not be operated until a user may remove and return his hand from in front of a sensor. Operation of the pump for short spaced periods of time greatly increases the efficiency of power usage and, therefore, the amount of fluid which can be dispensed with any given set of batteries as compared to continuous operation of the motor.

The control mechanism preferably includes or is in the form of an electronic control circuit. Such an electronic chip which may be mounted, for example, to the motor for convenience. An electronic control in the form of a programmable chip could be provided at relatively low cost and which could be simply customized for specific applications.

The control mechanism may include many features. For example, the control mechanism may require a waiting period after operating to dispense a single dose before the motor may be operated again to dispense a further dose. The control mechanism may include a counter mechanism which counts the number of times the motor has been operated to dispense individual doses and a reset mechanism which senses when a new unit 12 is inserted such that the control mechanism could be programmed to indicate the container to be empty when a predetermined number of doses has been counted as dispensed. The control mechanism may include a light indicator to identify when the container is empty of fluid and/or other light indicators which may indicate low battery conditions, satisfactory electronic performance and positive supply of fluid in the container.

The control mechanism may preferably include a mechanism to sense the voltage and amperage of the power source and to vary the length of time the motor is operated as a function of battery voltage and amperage. In this manner with reducing voltage and/or amperage of the battery, and the resultant reduced speed of revolution of the motor, the motor can be operated for a longer time period to dispense a constant unit dosage notwithstanding normal battery degradation. Such a compensating control for battery condition can, in combination with a counter mechanism, assist in more accurately setting the number of doses which may be dispensed before the container is calculated to be empty.

The control mechanism preferably is programmable such that it can be set to operate under different conditions. In a preferred embodiment which uses a photodetection sensor to sense the presence of a user's hand by sensing reflected signals from a signal emitting source, the same photodetection sensor could be adapted to receive signals such as infrared signals from a handheld programming device. Via signals from the programming device, the operation of the control mechanism could be reset as to permit changes such as changing the volume of the full fluid container, the unit dosage, the viscosity of the fluid being dispensed, battery type, to reset counting and the like. The control mechanism may provide a mechanism for feedback as to its condition and state of operation, as to the operator through an LED display on the dispenser or via the signal emitting source to displays carried on the programming device. Feedback as to the state of operation and condition such as the number of doses dispensed would be useful to persons maintaining the system. A handheld programming device could be similar to remote control units used to control the operation of televisions and the like.

To enhance battery life, it is preferred that the control mechanism be selected and the device operated to minimize energy consumption and thus it is preferred that the energy consumption of the control system itself be minimized. For example, in the context of a sensor mechanism utilizing a infrared LED emitter, the control mechanism should cause the emitter to pulse only once every few seconds so as to minimize power consumption by the generated pulses.

Towards providing a dispenser which can utilize batteries for the dispensing of fluid in an efficient manner, it is desired that the energy required for dispensing a predetermined amount of fluid be minimized. The invention of the present application is specifically directed to providing an energy efficient utilization of the motor and pump towards maximizing the amount of fluid which can be dispensed as with a given amount of battery electric energy. In this regard, the physical size of the impellers 46 and 48 is preferably chosen to be relatively small. Preferred impellers shown in the drawings have a gear portion with a diameter from tooth tip to tooth tip in the range of about 2.0 to 0.5 centimeter and an axial length of the gear-like portion 58 in the range of about 2.0 to 0.2 centimeters. The impeller members are preferably made of a lightweight plastic material so as to minimize their mass. Preferably, each impeller has central bore 78 to further reduce its mass. The impellers 46 and 48 and the cavity 50 are sized so as to minimize friction between the impellers and the pump casing 52. The fact that the impellers do not substantially frictionally engage the surfaces of the casing assists in reducing frictional forces required to rotate the impellers, however reduces the extent to which the impellers prevent leakage of the fluid through the pump. The present inventors have found that the preferred operation of the impellers at high speeds of rotation provides adequate pumping and the reduction of the efficiency of the pump itself due to leakage is offset by the improved efficiency in the use of the battery energy in permitting high speed efficient rotation of the motor and the impellers as is favoured by reduced friction between the impellers and the casing.

The preferred embodiments show the axle 98 of the rotor 96 of the motor 82 connected directly to the driven impeller 46 for direct rotation without any intermediate gearing. To the extent that intermediate gearing is provided, it is believed that such gearing increases the mass to be rotated, increases frictional forces to be overcome and reduces the energy efficiency. The simple gear type rotary pump shown in FIGS. 1 to 4 provides a simple inexpensive construction of the impellers which can accommodate high speed impeller operation with direct driving from the axle of the electric motor and efficient usage of battery energy.

In one exemplary configuration of the invention having a configuration as shown in FIGS. 1 to 4, a motor was utilized available under the JOHNSON trade name as part number PC200G having a preferred power source of 6 volts at a nominal current of 0.5 amps and a size of about 39 mm by 11 mm. Four AA VARTA (trade mark) alkaline extra longlife batteries were used connected in series to develop 6 volts and 2.3 amps service. The pump had a configuration with the impellers having a gear portion with a diameter from tooth tip to tooth tip of about 1.0 centimeter and an axial length of the gear like portion 58 of about 0.5 centimeter. With such a configuration, the applicant surprisingly found that in operation of the motor for approximately one second, preferably 0.6 second, the impellers rotated at speeds of approximately 3,000 r.p.m. and dispensed a suitable unit dosage of typical liquid hand soap. With this configuration, four AA batteries were found capable of dispensing about 20 liters of such soap which would represent, for soap dispensers in many commercial locations, a typical volume of soap dispensed in about a twelve to twenty month period.

The container and pump unit 12 shown are preferably disposable and recyclable. In this regard, each element of the unit is preferably formed from recyclable plastic material. The container 16 illustrated in FIG. 1 is a known collapsible container form made of recyclable plastic material. Similarly, the cap 24 and its one-way valve 34 can all be made from recyclable plastic materials. Each of the feed tube 40, exit tube 42, primary casing member 54 and casing plug 56 as well as the two impellers 46 and 48 and the extension rod 80 are each preferably formed from recyclable plastic material. Thus, the entirety of the unit 12 is preferably formed from recyclable plastic material which can, after use, readily be recycled.

Figure 5:
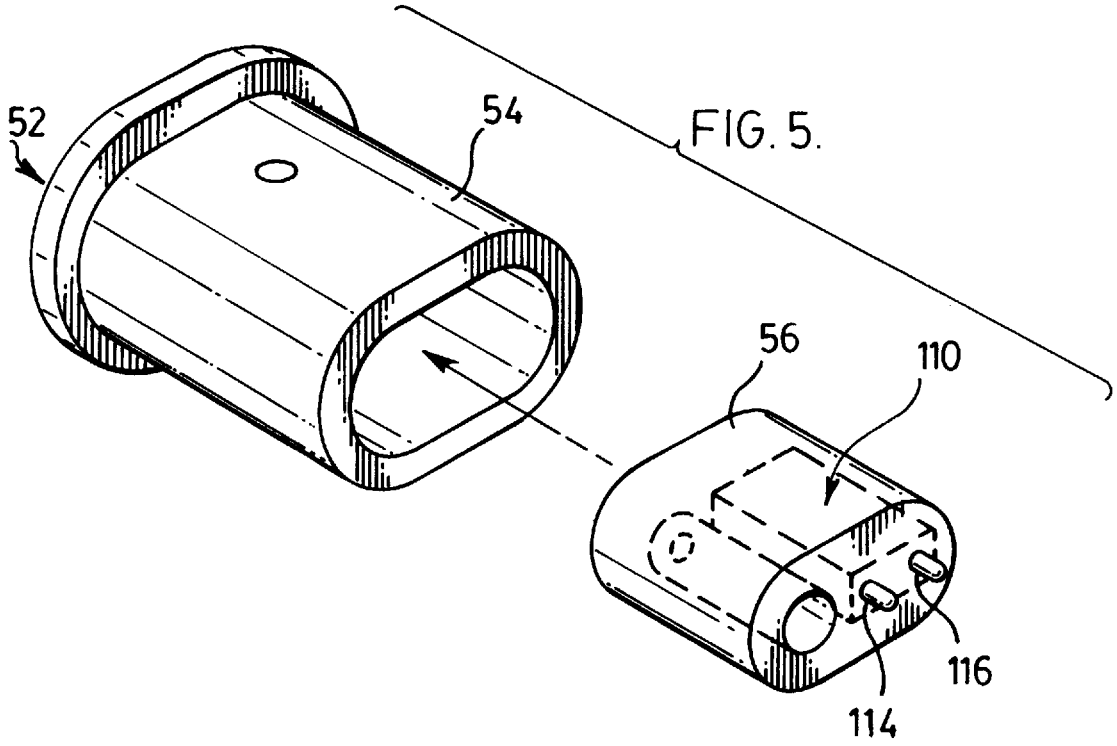
FIG. 5 is an exploded view showing a pump identical to that shown in FIG. 3, however, with a modified battery containing plug.

Reference is now made to FIG. 5 which shows a modified form of the pump 20 so as to provide integral with pump 20 and therefore with the unit 12 a removable and disposable battery 110. The pump 20 of FIG. 5 is identical to that in FIG. 3 with the exception that the casing plug 56 includes a further rearwardly opening cavity in which a battery 110 is provided. The battery 110 is shown as having positive and negative electrical male connector pins 114 and 116 which extend rearwardly from the battery and are adapted to be engaged into female contact receptacles disposed within the base of the socket 108 but not shown in the Figures. It is to be appreciated, therefore, that by rearward sliding insertion of the pump casing 52 as shown in FIG. 5 into the socket 108 that the pump comes to be engaged with the motor 82 and, in addition, the battery 110 comes to be electrically connected with the electrical system of the control mechanism controlling the dispenser and its motor.

A removable unit 12 as shown in FIG. 1 in which the pump casing 52 carries both pump 20 and a battery 110 as shown in FIG. 5 would, in fact, provide a replaceable and disposable unit with each of a set amount of fluid 18, a disposable pump 20 and a disposable battery 110. The battery 110 is preferably of a size so as to provide adequate electric power to dispense the amount of fluid 18 in its associated container 16. Once all fluid in the container 16 has been dispensed, the entire unit 12 would be removed for disposal. The battery 110 is preferably received in the plug 56 such that it can be manually removed from the plug such that the battery may be removed for separate recycling and disposal of the battery from the remainder of the unit.

Figure 6:
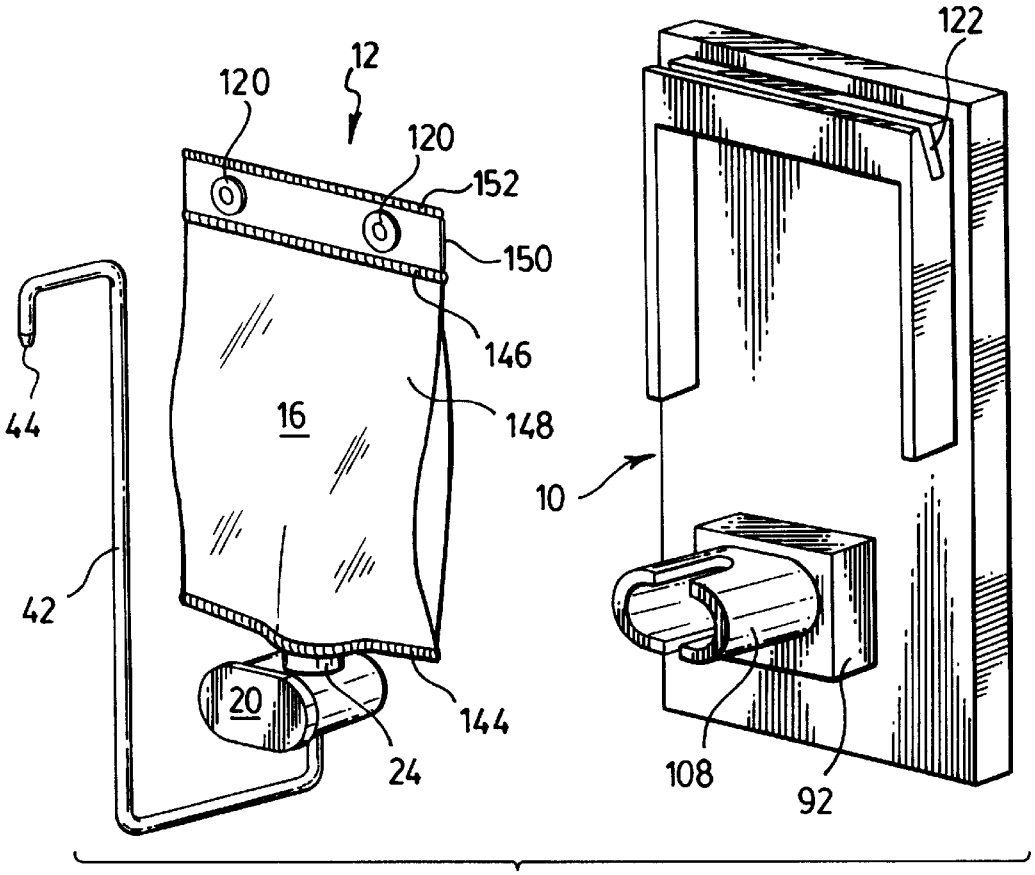
FIG. 6 is an exploded pictorial view of a disposable unit and housing of a second embodiment of the soap dispenser in accordance with the present invention.
Figure 7:
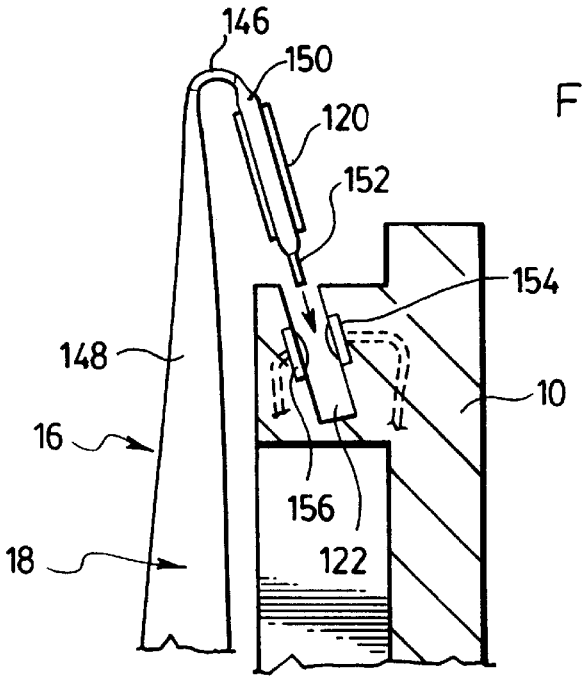
FIG. 7 is an enlarged pictorial view of the soap dispenser shown in FIG. 6 illustrating coupling of the bag with the housing.

Reference is now made to FIGS. 6 and 7 which show a second embodiment of a dispenser in accordance with the present invention having a number of alternative features.

FIG. 6 shows the unit 12 as having a container 16 comprising a flexible gossetted bag formed from an open ended tube preferably of plastic. The plastic bag 16 is secured as by heat welding by a first weld joint 144 at its lower end joining the tube on to itself and onto the outer circumference of a cylindrical outlet forming cap 24 similar to the cap 24 in FIG. 1 and to which a pump 20 is integrally connected. The top of the bag 16 is sealed by a second weld joint 146 to form a fluid compartment 148 for fluid communicating with the pump 20.

The bag 16 is shown as having an auxiliary compartment 150 sealed between second weld joint 144 and a third weld joint 152 to be separate from fluid within the bag. Two conventional disc-like batteries 120 are secured in desired locations in the auxiliary compartment 150 between the sides of the tube. The housing 10 is shown as being provided at its upper end with an upwardly opening slot 122 such that as best seen in FIG. 7 the compartment 150 containing the batteries is adapted to be slid downwardly into the slot 122 such that the batteries 120 may make electrical connection each with a positive connector 154 and negative connector 156 disposed within the slot 122 for each battery. In respect of electrical connection between the batteries and the connectors within the slots 122, a number of different arrangements can be used. For example, each of the connectors may comprise a vertically extending knife-like member which, on insertion of the compartment 150 downwardly into the slot 122, may cut through the plastic forming the compartment holding the batteries and permit electrical connection between the connectors and the batteries. Alternatively, at the time when forming the compartment 150 with the batteries located in place, the plastic forming the sides of the compartment about the batteries may be cut away over sections of the batteries to expose the battery terminals. Further alternatively, in forming the compartment 150, removable tear strips may be provided over portions of one or both sides of the compartment which can be removed prior to insertion of the batteries into the slots and which, on removal, expose the batteries.

In the context of the embodiments shown in FIGS. 6 and 7, the insertion of the compartment 150 into the slot 122 not only electrically connects the batteries to the electric system in the housing but also serves as a mechanical means for hanging of the flexible container 16 supported on the top rear of the housing. FIG. 6 shows that the housing 10 without support plate 32 as shown in FIG. 1 and with the unit 12 to be supported by the housing on slot 122 and by the pump 20 being received within the socket 108 in the motor casing 92.

A container 16 similar to that illustrated in FIG. 6 could be provided for support on the housing by some method other than that shown in FIGS. 6 and 7 and with the auxiliary compartment 150 merely serving a function of a carrier for batteries which is integral with the unit 12 and preferably keeps the battery or batteries in sealed condition ready for use. In this context, a unit comprising the container 16, pump 20 and one or more battery may be provided. Prior to insertion of the unit 12 into a dispenser, the compartment 150 would be opened and the battery would then be removed from the compartment and suitably inserted into a receptacle in the dispenser for use to power the motor. Such a battery could include specifically customized batteries including flat, credit-card like batteries or plate batteries and rather known batteries of conventional size and shape.

In FIG. 6, the exit tube 42 is shown to have increased length and to extend upwardly to present the dispensing outlet 44 at a height above the level of fluid within the container 16. This configuration is particularly advantageous when the fluid to be dispensed is of low viscosity and there is increased risk of leakage through the pump. Such fluids include low viscosity alcohol solutions and antiseptic washes as used in hospitals. Providing an exit tube 42 with the dispensing outlet above the height of fluid in the container can avoid the need to provide anti-dripping mechanisms such as one-way valve in FIG. 2 to prevent dripping of the fluid through the pump. While such anti-dripping mechanisms can be provided and may be advantageous in many circumstances, avoiding the use of a check valve is advantageous to minimize the frictional forces arising in fluid flow which are required to be overcome by the pump with a view to increasing the useful life of batteries and, therefore, minimizing the size and quantity of batteries required to dispense the fluid from any container.

Figure 9:
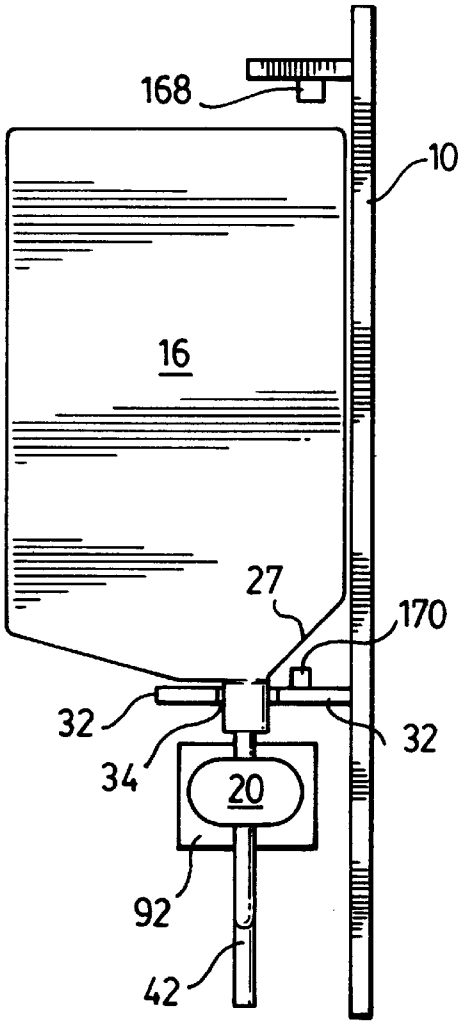
FIG. 9 shows a schematic side view of the dispenser of FIG. 8.
Figure 8:
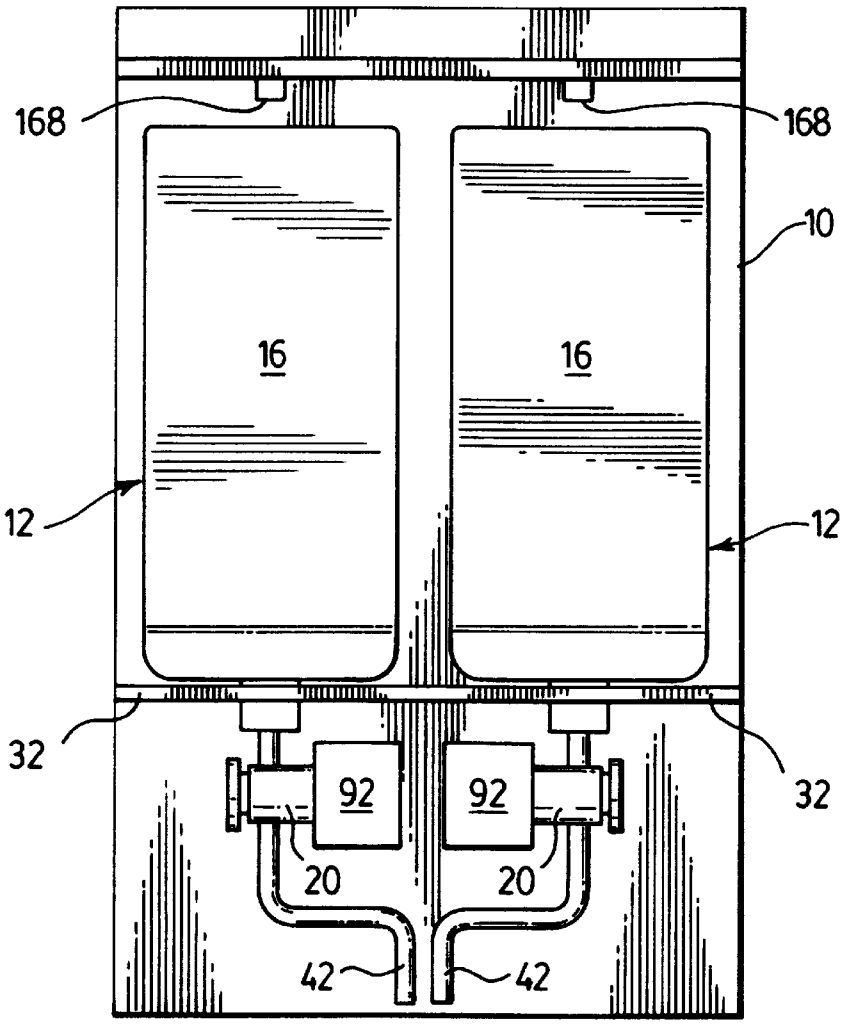
FIG. 8 shows a schematic front view of a third embodiment of a soap dispenser in accordance with the present invention with its cover removed.

Reference is made to FIGS. 8 and 9 which shows a third embodiment in accordance with the present invention. In FIGS. 8 and 9, the dispenser has a single housing 10, however, duplicates the unit 12 and motor such that there are two parallel systems each comprising a unit 12 with a container 16 and pump 20 independently coupled to a separate motor received in a motor housing 92 substantially as in a manner described with the other embodiments.

The embodiment of FIGS. 8 and 9 are configurated with the units 12 to be coupled and uncoupled by horizontal sideways sliding of the unit 12 onto the housing 10.

In this regard, support plate 32 has two U-shaped slots 34 each open to a respective side of the plate 32 and both motors are disposed in a housing 92 laterally inside pump 20 with the axle of each motor extending horizontally to the side.

The two exit tubes 42 are shown to extend to a relatively common dispensing location at the bottom of the housing. A single cover (not shown) would preferably cover the entire unit. This unit would have a single electronic control adapted to control both motors. The control would control operation such that fluid from a first unit 12 would be pumped out entirely until the container 16 of that first unit is substantially emptied. A sensor would sense when the container of the first unit is substantially empty and, at that time, commence to pump fluid from the container of the second unit 12. This would have the substantial advantage that in servicing the dispensers, one unit may be left in the dispenser until after its container is empty in that even after the container of one unit is empty, there is still a full container for second unit to be dispensed before both containers for the dispenser are empty. Thus, in use, the dispenser could start with two units 12 having full containers 16. The control would dispense substantially all of the fluid from the container of the first unit and then commence to dispense fluid from the second unit. The dispenser would be manually monitored such that only after the dispenser commences to dispense fluid from the second unit would the first unit be replaced by a new unit with a full container. After the fluid has been dispensed from the second dispenser, the control would then commence to dispense fluid from the first unit. The control mechanism would preferably include indicator lights to indicate which of the dispensers has fluid which can be dispensed and which of the dispensers are empty. Preferably, these indicators would be visually externally to avoid the need of a person manually inspecting the unit to open or remove any cover.

Each of the two units shown in FIGS. 8 and 9 could be provided with their own batteries replaceable with replacement of each unit. The power, however, from the batteries could be combined such that in the event of a possible malfunction of one battery from one of the units, the battery from the other unit might continue to ensure proper operation.

In the context of FIG. 8, the exit tubes 42 are located beside each other at the bottom of the dispenser and a user would therefore appropriately direct his hand for receipt of the fluid as in the manner of a dispenser with a single unit. Having a dispenser with two duplicate units and a control system to identify when one unit may be empty or to determine a malfunction in respect of one unit and which control then provides for dispensing from the second unit are a number of advantages over dispensing devices having but a single unit.

While not shown, the device of FIGS. 8 and 9 may advantageously utilize additional light emitters and sensors to sense the presence of a user's hand under the dispenser, as in the manner with the embodiment of FIG. 1.

The containers 16 illustrated in FIGS. 1 and 5 both are collapsible containers, that is, containers which would collapse upon themselves on the fluid 18 is dispensed from the containers. It is to be understood that the invention is also useful with containers which are not collapsible as, for example, in FIGS. 8 and 9 with rigid containers which are provided with an air vent mechanism whereby air may be permitted to enter the container on fluid being dispensed. Such rigid, non-collapsible containers are known to be made entirely out of various recyclable materials including glass and plastic and to have a vent which may be opened as by removing a tear away or adhesive vent cover. Alternatively, a one-way valve structure can provide a means for permitting air to enter the non-collapsible retainer when a partial vacuum is developed in the container. The containers 16 may also be containers which can be refilled as, for example, with an opening in their top for refilling when installed in a dispenser.

The preferred embodiment of FIG. 1 shows the container 16 as formed from separate elements including a one-piece container 16, the cap 24 with a separate flapper member 36 and a separate feed tube 42. Any two or more of these elements could be combined so as to provide a lesser number of parts and to possibly simplify manufacture. Similarly, these parts could be formed to be integral with the primary casing member 54 and/or the exit tube 42.

Dispensers could be provided without a one-way valve and in such configurations, particularly when provided from a bag such as shown in FIG. 6 which is to be filled from its upper end which can later be sealed, it may be possible to configure the container 16 as a unitary integral member including the bag, cap and feed tube.

Providing a one-way valve assists in preventing fluid dripping from the outlet 22 when the pump is not operated.

The one-way valve formed by flapper member 36 provides an inherent bias against flow in the permitted direction which bias in the context of the one-way valve shown in FIG. 2 represents the inherent bias of the circumferential portions of the flapper member 36 against the seating surfaces of plate 25 about the opening 38. The flapper member resists flow in the desired direction until a certain minimum pressure differential is obtained as is advantageous to stop dripping. On the other hand, the requirement of a minimum pressure differential for fluid flow should be minimized so as to not unduly increase the power consumption required to dispense fluid. However, various other systems to reduce dripping can be provided as, for example, including the system shown in FIG. 6 in which the dispensing outlet 44 is disposed at a height above the fluid 18 in the container 16. The propensity of any dispensing system to leak out the dispensing outlet when the pump is not operated will be a function of the nature of the fluid to be dispensed and the size and configuration of the components forming the dispenser. With relatively viscous product such as hand soap and products such as ketchup and mustard, there may be little propensity for the fluid to leak having regard merely to the size of the passageways through which the fluid must flow to exit out the dispensing outlet. Having regard to the nature of the fluid being dispensed, the exit tube 42 could be provided with an area of restricted cross-sectional area as, for example, at the outlet opening itself so as to substantially reduce dripping by reason of the viscosity and surface tension of the fluid to be dispensed. Again, the extent to which this restriction could be narrowed needs to be tempered having regard to the ability to reduce dripping on one hand and, on the other hand, to not unduly increase the power consumption required for dispensing.

To the extent that a one-way valve is required or some other mechanism is desired to prevent dripping or otherwise, it is possible to place the mechanism either upstream from the pump or downstream from the pump. Thus, towards simplifying manufacture, a one-way valve could be provided in exit tube 42.

Towards reducing the likelihood of dripping, the control mechanism could control operation of the motor 82 such that in the context of the reversible pump 20 shown in FIG. 1, after the pump is operated to dispense a unit dose of a predetermined amount of fluid, the pump may then be reversed to draw back fluid to a predetermined extent. Thus, for example, in an embodiment in which the flapper member 36 is not provided, it might be possible to reverse the pump for a sufficiently short period of time that fluid is merely drawn back upwardly out of the exit tube 42 so that air fills the exit tube 42 and the presence of air in the exit tube 42 may assist in reducing the likelihood of dripping. The control mechanism may be adopted to control the manner and nature of dispensing having regard to any particular needs.

The preferred embodiments have been described with particular reference to a conventional soap dispenser which is adapted for mounting in a conventional manner as on a vertical wall as in a washroom proximate a sink. The invention is not so limited. The dispensers could be free standing or mounted by other arrangements. For example, a dispenser with an exit tube 42 as shown in FIG. 6 could readily be adapted to be placed on a countertop.

The dispensing apparatus in accordance with the present invention is particularly described for dispensing fluid such as hand soap. The dispenser, however, is useful for dispensing many other products such as condiments including ketchup, mustard and mayonnaise. The dispensing apparatus would also be useful in dispensing food products such as cream and milk for dispensing into beverages such as tea and coffee and for dispensing concentrates for beverages such as liquid concentrates for coffee, hot chocolate, tea, concentrated fruit juices and concentrates for soft drinks and the like. The device would be useful for dispensing liquid medicine, disinfectants and antiseptic cleaning solutions, liquids and creams. The device could be utilized for dispensing metered amounts of lubricating oils, dyes for paint and the like. The device is particularly advantageous for use in situations where it is difficult or awkward to provide permanent power sources.

The preferred embodiments illustrate the use of a number of different forms of replaceable batteries as is preferred. Such batteries may be provided to have a life which would meet the expected power needs over a set period of time as, for example, to be replaced every six or twelve months and cover normal usage in those times. A preferred configuration is to provide a separate battery for each replaceable unit 12 such that the battery will have a capacity to ensure dispensing of all the fluid in a given container 16 and will be replaced by a new battery on replacement of the container 16. With other configurations, a single battery may be provided for a life of the dispenser, say, three to five years.

Various systems for providing electric power may be provided. For example, rather than utilize batteries, a converter/adapter may be provided permanently coupled to an AC power source so as to provide DC power of a desired voltage and amperage. The DC adapter could be provided remote from the dispenser with merely electrical wires carrying the low voltage DC power extending to the dispensers. The device could be provided with photoelectric cells as, for example, on the top of the housing 10 which would generate electric power from light and could store power in rechargeable batteries and/or capacitors as in the manner of known photoelectric cells on handheld calculators.

Separate power sources such as separate batteries may be provided for each of the electronic control system and for the motor. This would permit an electronic control system, for example, to continue to operate and indicate a low battery condition regarding the motor even though the battery for the motor may be fully discharged.

Many different mechanisms may be provided for sensing when either of the containers 16 is substantially empty. At the time of commencing to dispense from each new unit 12, the control mechanism could utilize a counter which would count the number of doses of a predetermined amount of fluid dispensed and, thus, on a predetermined basis, knowing the volume of fluid in a full container count the appropriate number of doses dispensed when substantially all of the fluid should have been dispensed from the container. This number should be pre-set to have a margin of error which ensures that within all reasonable probabilities, at the time of last attempting to dispense fluid from one container, there will at least some fluid left to dispense. As a reset mechanism, if each unit carries its own battery, the control mechanism could sense when the battery is removed and utilize this to reset the counter for the appropriate unit.

An alternate system for sensing when a container may be empty is to have the control mechanism measure the resistance of the axle of the motor to rotation as by measuring the power draw required to turn the motor. To the extent that this power draw decreases below a predetermined amount, then this may be an indication that the impellers are turning freely as, for example, without a viscous fluid being pumped therethrough. Similarly, the control mechanism could utilize such a power measuring circuit to indicate if a jammed condition arises and stop supply of power to that motor.

Another system for determining when a container is empty is via a light emitter and a light sensor. A light emitting diode can be provided at a location, for example, where the light from the diode must pass through portions of the fluid in the container to reach the light sensor. To the extent the fluid in the container substantially prevents or reduces passage of light from the emitter to the sensor, the sensor could be arranged such that light from the emitter is only passed to the sensor when the container is substantially empty of fluid. For example, as seen in FIG. 9, a light emitter 168 is provided on the housing 10 above the container 16 and directs light downwardly toward a sensor 170 disposed on the support plate 32 underneath the shoulder 27 of the container 16. The nature of the light emitter 168 and sensor 170 could be selected having regard to the nature of the fluid and the nature of the materials forming the container. To the extent it may prove necessary, a shield or vertical plate could be provided between the two units 12 such that light from the emitter of one unit is not picked up by light from the emitter for the other unit. Alternatively, emitters of different frequency could be used. While an emitter may be able to direct light vertically downwardly to a sensor, alternatively, the light from the emitter could be directed forwardly and downwardly to reflect off a front surface of the container and, hence, be picked up by the sensor. In this regard, the container may be desired to be provided with transparent or less opaque portions to permit the light to pass into and out of the container. The container might also be desired to be provided with reflective forward surfaces as, for example, by having a metallized tape applied to a portion of the exterior front surface which reflective tape might comprise the backing of an adhesive label. The light emitter would preferably be provided to send pulses of light at spaced time so as to minimize the consumption of energy.

To assist the use of light emitters and light sensors to detect the presence or absence of fluid in a container 16, in accordance with the invention, it is possible to provide the fluid with particular additives or ingredients such as specific colour dyes. For example, to the extent a soap may have a blue colour, then the soap may have an increased ability to absorb a specific wavelength of light as, for example, in the blue colour spectrum and an appropriate selection of light for use in this range might provide enhanced detection. Similarly, the use of wavelengths of other lights may provide for enhanced detection of the presence or absence of fluid in the container having regard to the nature of the fluid and/or the nature of the materials of the container.

In accordance with the present invention, it is preferred that the unit 12 comprise a container 16 and a pump 20 as a unit which is replaced together. It is to be appreciated, however, that each unit may have a container 16 which is severable from the pump 20 and that the pump may be replaced, if desired, less frequently than the container. For sanitary purposes and particularly in the context of food and the like, it is preferred that a unit comprising the container and the pump be replaced in its entirety.

The invention of the present application may also provide as a disposable unit a container 16 together with a battery. In the context of FIG. 6, the bag carrying the battery in its auxiliary compartment 150 could be provided separate from the pump with the pump either being permanent or being provided for replacement less frequently than the combination of the container 16 and its batteries.

Reference is made to FIGS. 11 to 13 which show a fourth embodiment of a dispenser in accordance with the present invention. In FIG. 11, the dispenser comprises a housing 10 with a removable disposable unit 12. The disposable unit 12 is formed so as to provide a decorative front and avoid the need for a separate cover. As best seen in FIGS. 11 and 13, the container 16 has at its upper rear two blind bores 172 which are adapted to be engaged on complementary forwardly directing posts 174 provided on the housing 10 to substantially support the container 16 on the housing. The container 16 has its rear and bottom wall deformed upwardly and forwardly so as to provide a slot 176 which is complementary in vertical cross-section to the vertical cross-section through the motor casing 92 and serves to engage the motor casing 92 to assist in supporting the container 16. The slot 176 extends forwardly from the motor casing and, as best seen in FIG. 12, provides a protected cavity in which there is carried a pump 20 substantially the same as the pump of FIG. 1. The container 16 has a feed outlet 180 in a forward face of the slot through which a feed tube 40 passes extending downwardly inside the container to a well formed in the container. Feed tube 40 extends through the container wall in sealed relation thereto an inlet port in the pump 20 provided to extend axially through the front face of the primary casing member 54 to the cavity 50 above the nip in the gears. The exit tube 42 extends downwardly from the pump 20 as in FIG. 3. With the pump carried on the unit 12 and, preferably, with the pump casing 52 carrying a removable battery as shown in FIG. 5, the unit 12 comprises a disposable combination of the container 16 containing the fluid 18 together with a disposable pump 20 and a disposable battery. The unit is very sanitary in that with each replacement of the unit, the entire dispensing unit is disposed of and merely the housing remains presenting its components readily accessible for cleaning. As shown in FIG. 11 by providing the pump located at the bottom of the motor casing 92, the pump can be located substantially at the bottom of the rigid container 16 near a well in its bottom. The pump 20 could also be slightly reconfigured with the inlet port to be below the nip 66 in FIG. 3 and the exit port to be above the nip. This would have the advantage of providing the inlet to the pump located at the bottom of the pump and closer to the bottom of the well in the container. The unit 12 can be coupled to the housing merely by forward and rearward movement of the unit 12. The light emitter 138 and light sensor 140 are carried on the bottom of the motor casing 92 and open to direct and sense light reflected of a user's hand under the dispenser.

The preferred embodiments illustrate the motor as presenting its axle disposed horizontally for coupling with the pump by horizontal sliding of the pump coaxially thereto. It is to be appreciated that the pumps illustrated in the preferred embodiments would operate to pump fluid whether they are disposed with the axis their impellers horizontal, vertical or at any angle or orientation thereto. Providing the axis of the motor to be horizontal provides for a simplified horizontal sliding engagement of the pump onto the motor axis for coupling as shown in FIG. 1 for rearward sliding or as shown in FIG. 8 for sideways sliding is preferred. It is to be appreciated that horizontal sideways relative sliding of the pump onto the motor and/or vertical downward or upward sliding engagement of the pump to the motor axis could as easily be provided.

While the invention has been described with reference to preferred embodiments, many modifications and variations will occur to persons skilled in the art. For a definition of the invention, reference is made to the following claims.

We claim:

1. A device for dispensing a fluid comprising:

a housing;

a removable, replaceable unit removably mounted to the housing;

the unit including: a container for fluid to be dispensed; and a pump activable to dispense fluid from the container;

the pump having a rotatable input member extending therefrom; the pump operative to dispense fluid from the container by rotation of the input member, the housing comprising:

a motor with a rotatable output member; and a motor control mechanism for controlling operation of the motor;

the motor output member removably coupled to the input member of the pump for rotation of the pump on operation of the motor, the motor comprising an electric direct current motor with a rotor journalled for rotation about an axle relative a stator fixed to the housing, a coaxial extension of the axle comprising the motor output member;

the pump removably coupling with the motor by sliding of the pump relative the housing parallel the axle of the motor, the container removably coupling with the housing for support of the container by the housing by sliding of the container relative the housing parallel the axle of the motor such that by sliding of the unit relative the housing the container is coupled to the housing and simultaneously the pump is coupled to the motor.

2. A device as claimed in claim 1 wherein the axle of the motor is horizontal.

3. A device as claimed in claim 1 wherein the coaxial extension of the axle of the motor extends forwardly relative the housing and the container couples to the housing and the pump couples to the motor by rearward horizontal sliding relative the housing.

4. A device as claimed in claim 1 wherein the unit carries a battery such that the battery removably electrically couples to the motor control mechanism on sliding of the unit relative the housing parallel the axle of the motor to couple the container to housing and the pump to the motor.

5. A device as claimed in claim 2 wherein the pump is received in a casing secured to the container, a socket is carried on the housing to receive the casing therein on sliding of the casing into the socket parallel the axle of the motor such that with the casing received in the socket engagement between the casing and the socket coaxially aligns the extension of the axle with the input member of the pump for coupling on sliding parallel the axle of the motor.

6. A device as claimed in claim 5 wherein the housing includes vertically upwardly directed container support surfaces on the housing to engage vertically downwardly directed engagement surfaces on the container and support the container on the housing, the container support surface and engagement surfaces being engageable by sliding of the container relative the housing parallel the axle of the motor.

7. A device as claimed in claim 6 wherein the container having an outlet in its bottom in communication with the pump and the engagement surfaces are provided on the container on either side of the outlet, the housing having a horizontally extending support plate with an opening therethrough extending from a distal edge of the plate in a direction parallel the axle of the motor and through which the outlet of the container extends downwardly with the plate carrying the container support surfaces on either side of the opening.

8. A device as claimed in claim 2 wherein the pump comprises: a casing, an enclosed cavity defined within the casing, and two gear-like impellers each having an axis and radially extending teeth;

the impellers journalled for rotation within the cavity adjacent each other with their axes parallel and with teeth of one impeller intermeshing with the teeth of the other impeller in a nip between the impellers, an inlet port through the casing open to the cavity on a first side of the nip, an outlet port through the casing open to the cavity on a second side of the nip opposite the first side, interior surfaces of the cavity closely enclosing the impellers such that on rotation of the impellers, fluid is impounded in spaces between adjacent teeth of each impeller and interior surfaces of the casing and moved with rotation of each impeller circumferentially from one side of the nip where the teeth disengage from intermeshing to the other side of the nip where the teeth engage into intermeshing, the inlet port communicating with the container;

the outlet port communicating with an outlet, wherein on rotation of one of the impellers in a pumping direction, the pump pumps fluid from the container via the inlet port to the cavity through the cavity and via the outlet port out of the cavity to the outlet.

9. A device as claimed in claim 8 wherein the input member of the pump member comprises an extension of one impeller along its axis, and the output member of the motor and the input member of the pump when coupled form an integral axle directly coupling the rotor to the impeller with the rotor disposed coaxially about the axis of the impeller, and the motor and impeller rotate in unison at speeds in the range of 2,000 to 6,000 revolution per minute.

10. A device for dispensing a fluid comprising:

a housing;

a removable, replaceable unit removably mounted to the housing;

the unit including: a container for fluid to be dispensed; and a pump activable to dispense fluid from the container;

the pump comprises: a casing, an enclosed cavity defined within the casing, and two gear-like impellers each having an axis and radially extending teeth;

the impellers journalled for rotation within the cavity adjacent each other with their axes parallel and with teeth of one impeller intermeshing with the teeth of the other impeller in a nip between the impellers, an inlet port through the casing open to the cavity on a first side of the nip, an outlet port through the casing open to the cavity on a second side of the nip opposite the first side, interior surfaces of the cavity closely enclosing the impellers such that on rotation of the impellers, fluid is impounded in spaces between adjacent teeth of each impeller and interior surfaces of the casing and moved with rotation of each impeller circumferentially from one side of the nip where the teeth disengage from intermeshing to the other side of the nip where the teeth engage into intermeshing, the inlet port communicating with the container;

the outlet port communicating with an outlet, wherein on rotation of one of the impellers in a pumping direction, the pump pumps fluid from the container via the inlet port to the cavity through the cavity and via the outlet port out of the cavity to the outlet;

wherein on rotation of one of the impellers in a pumping direction, the pump pumps fluid from the container via the inlet port to the cavity through the cavity and via the outlet port out of the cavity to the outlet;

the pump having a rotatable input member coupled to one of the impellers for rotation together and extending out of the casing;

the housing comprising:

a motor with a rotatable output member; and a motor control mechanism for controlling operation of the motor;

the motor output member removably coupled to the input member of the pump for rotation of the impellers of the pump on operation of the motor.

11. A device as claimed in claim 10 wherein the motor comprises an electric direct current motor with a rotor journalled for rotation about an axle coaxially within a stator;

the output member of the motor comprises an axially extension of the axle, the input member of the pump member comprises an extension of one impeller along its axis, and the output member of the motor and the input member of the pump when coupled form an integral axle directly coupling the rotor to the impeller with the rotor disposed coaxially about the axis of the impeller.

12. A device as claimed in claim 11 wherein the motor and impeller rotate in unison at speeds in the range of 2,000 to 6,000 revolutions per minute.

13. A device as claimed in claim 10 wherein the container and pump are formed entirely from recyclable plastic materials.

14. A device as claimed in claim 10 wherein the unit incorporates a battery carried on the unit such that in engagement of the unit to the housing, the battery is electrically connected to the motor control mechanism to provide electrical power for the motor.

15. A device as claimed in claim 14 wherein the battery is severable from the unit for disposal after use separate from the unit.

16. A dispenser as claimed in claim 10 wherein the container has an outlet in communication with the inlet port of the pump;

the housing receives the unit with the container having its outlet at the vertical bottom of the container for gravity feeding of fluid via the outlet and the inlet port to the pump;

the motor carried on the housing at a height below the outlet.

17. A device for dispensing a fluid comprising:

a housing;

a removable, replaceable unit removably mounted to the housing;

the unit including: a container containing a predetermined quantity of fluid to be dispensed; and a pump activable to dispense fluid from the container;

the pump having a rotatable input member; the pump operative to dispense fluid from the container by rotation of the input member, the housing comprising:

a motor with a rotatable output member; and a motor control mechanism for controlling operation of the motor;

the motor output member removably coupled to the input member of the pump for rotation of the pump on operation of the motor, the unit including a battery of an electrical capacity at least sufficient to power the motor and motor control mechanism to dispense with the pump the predetermined quantity of the fluid in the container.

18. A device as claimed in claim 17 wherein aside from the battery and the fluid in the container the entire unit is formed entirely from recyclable plastic materials.

19. A device as claimed in claim 17 wherein the battery is carried on the unit such that in engagement of the unit to the housing, the battery is electrically connected to the motor control mechanism to provide electrical power for the motor.

20. A device as claimed in claim 17 wherein the battery is severable from the unit for disposal after use separate from the unit.

* * * * *